US005276410A

United States Patent [19]

Fukuzawa et al.

[11] Patent Number: 5,276,410

[45] Date of Patent: Jan. 4, 1994

[54] CIRCULAR TO LINEAR POLARIZATION CONVERTER

[75] Inventors: Keiji Fukuzawa, Chiba; Yoshikazu Yoshida, Tokyo, both of Japan

[73] Assignee: Sony Corporation, Tokyo, Japan

[21] Appl. No.: 892,050

[22] Filed: Jun. 2, 1992

[30] Foreign Application Priority Data

Jun. 14, 1991 [JP] Japan ..... 3-169320

[51] Int. Cl.[5] ..... H01P 1/16; H01P 5/02

[52] U.S. Cl. ..... 333/21 A; 333/26; 333/254

[58] Field of Search ..... 333/21A; 333/26; 333/204; 333/254; 333/128

[56] References Cited

U.S. PATENT DOCUMENTS

| | | | |
|---|---|---|---|
| 3,089,103 | 5/1963 | Oliner | 333/26 X |
| 3,886,498 | 5/1975 | Mosko et al. | 333/128 |
| 4,233,579 | 11/1980 | Carlson et al. | 333/204 |
| 4,453,142 | 6/1984 | Murphy | 333/26 |
| 4,901,040 | 2/1990 | Ahlborn et al. | 333/254 X |
| 5,043,683 | 8/1991 | Howard | 333/21 A |
| 5,148,131 | 9/1992 | Amboss et al. | 333/26 |

FOREIGN PATENT DOCUMENTS

| | | | |
|---|---|---|---|
| 350324 | 1/1990 | European Pat. Off. . | |
| 2550891 | 2/1985 | France . | |
| 1-51801 | 6/1989 | Japan | 333/21 A |

OTHER PUBLICATIONS

The Abstract appearing in vol. 9, No. 147, published Jun. 21, 1985 from the Japanese Patent Office (Izumi).

*Primary Examiner*—Paul Gensler

*Attorney, Agent, or Firm*—Lewis H. Eslinger; Jay H. Maioli

[57] ABSTRACT

A converter for converting circularly polarized waves in a round waveguide into linearly polarized waves in a rectangular waveguide has two probes and a transmission line pattern all of which are formed of metal foil on a thin dielectric film board. The board is flexible and extends across the open ends of the two waveguides. The first probe has a square shape and the transmission line has two conductor arms connected to adjacent sides of the square. The other ends of the conductor arms are connected to the second probe with an impedance matching resistor formed on the film board between the two arms. One conductor arm is one-quarter wavelength longer than the other to convert from circularly polarized waveguide transmission to microstrip transmission.

17 Claims, 3 Drawing Sheets

CIRCULAR TO LINEAR POLARIZATION CONVERTER

BACKGROUND OF THE INVENTION

1. Field of the Invention

The present invention relates to a polarity converter for a parabolic antenna of the kind used in receiving satellite broadcasts or the like.

2. Description of the Background

In order to make it easier to install a parabolic antenna for receiving electromagnetic waves transmitted by a broadcast satellite, that is, in order to allow the receiving parabolic antenna to be installed without taking the polarity of the electromagnetic waves into consideration, such electromagnetic waves are typically transmitted from the satellite with a circular polarization. Thus, it is necessary to convert the electromagnetic waves with a circular polarization into ones with a linear polarization in order to efficiently transform the electromagnetic waves into an electrical signal. For this reason, a polarity converter is required when using a parabolic antenna.

FIG. 6 shows a typical configuration of a conventional polarity converter, in which a waveguide 2 is connected to a feedhorn 1, which has a circular cross section. A dielectric substance 6 is attached across the inside of a portion 3 of the waveguide 2 that is closest to the feedhorn 1. The dielectric substance 6 is fixed at an angle at a point along the length of the waveguide 2 on a diametrical line of the waveguide portion 3, the cross section of which is circular as described above. This dielectric substance 6 is used for converting the circular polarity of the received electromagnetic wave into a linear polarity.

A portion 5 of the waveguide 2 at the stage farthest from the feedhorn 1 is designed so that it is rectangular in cross section to facilitate the transmission of the electromagnetic waves with the linear polarity. A waveguide portion 4 between the portions 3 and 5 is a transition part of the waveguide 2 at which the circular cross section is gradually transformed into a rectangular cross section. Thus, the waveguide portion 4 linking the portions 3 and 5 to each other has a cross section which is a transition between the other two.

The conventional polarity converter is designed as a three-dimensional structure for converting circular-polarity electromagnetic waves into linear-polarity electromagnetic waves. As a result, the conventional polarity converter has several problems, such as large size and high cost to manufacture.

OBJECTS AND SUMMARY OF THE INVENTION

Addressing these problems, it is an object of the present invention provide a design for a small-size and low-cost polarity converter for use in receiving satellite broadcast signals.

According to an aspect of the present invention a polarity converter is provided that comprises a first probe installed at an end of a first waveguide typically having a circular cross section, two conductor branches stretched out from the first probe in directions different from each other to constitute a waveguide to microstrip conversion portion in conjunction with the first probe, and a second probe installed at an end of a second wave guide typically having a rectangular cross section, wherein the length of one of the conductor branches is one-fourth wavelength of the received electromagnetic wave longer than that of the other and both branches are connected to the second probe at their other ends to form, together with the first probe, a unitary conductor pattern on a thin, flexible, dielectric film board.

The manner in which the above and other objects, features, and advantages are provided by the present invention is set forth in the following description and drawings, in which like reference numerals represent the same or similar elements.

DETAILED DESCRIPTION OF PREFERRED EMBODIMENTS

Figure 1:
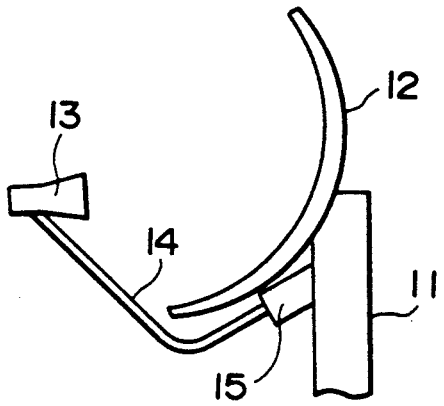
FIG. 1 is a side elevational view of a typical configuration of a parabolic antenna including a polarity converter as provided by the present invention.

The elevational view of FIG. 1 shows a configuration that implements a parabolic antenna for a satellite broadcast receiver/transmitter making use of the polarity converter provided by the present invention. As shown in FIG. 1, a reflector 12 is installed on top of a support pole 11, and a polarity converter 13 is fixed at the position to which electromagnetic waves reflected by the reflector 12 are converged. The polarity converter 13 is connected to a signal converter unit 15 by a waveguide 14.

With the reflector 12 directed toward a broadcast satellite, circular-polarity electromagnetic waves transmitted by the broadcast satellite are reflected by the reflector 12 and converged to the polarity converter 13. The circular-polarity waves entering the polarity converter 13 are transformed into linear-polarity waves that are then guided by the waveguide 14 to the converter unit 15. Subsequently, the converter unit 15 converts the linear-polarity waves into an electrical signal that is finally output to a tuner (not shown).

Figure 2:
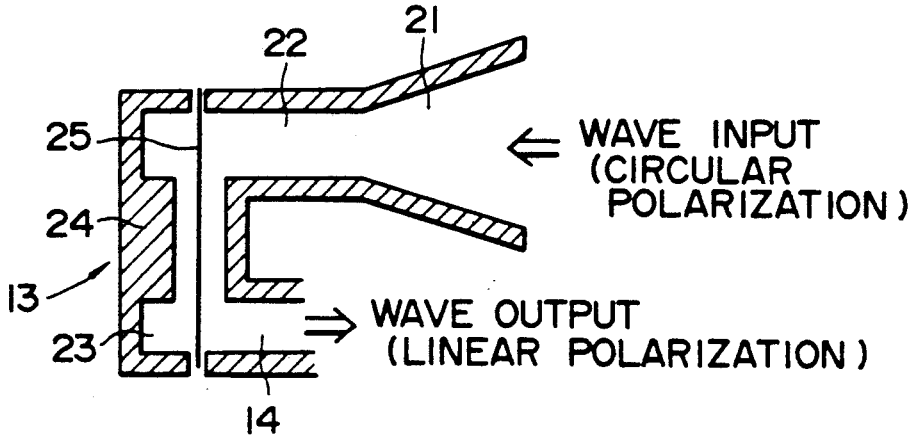
FIG. 2 is an elevation in cross section of a configuration of the polarity converter according to an embodiment of the present invention.

FIG. 2 shows the polarity converter 13 of FIG. 1 cross section in which feedhorn 21 is circular, so that it transmits the incoming circular-polarity waves reflected by the reflector 12. The other end of circular feedhorn 21 is connected to a waveguide 22, also having a circular cross section. Electromagnetic waves coming from the feedhorn 21 propagate along the inside of the waveguide 22 toward the other end of the waveguide 22. An end plate 24 is attached at the end of the waveguide 22 so as to form a space 23 between the end plate 24 and the end of the waveguide 22. A film board 25 is fixed in the space 23 between the end plate 24 and the end of waveguide 22. The end plate 24 extends beyond the end of the waveguide 22 so that the space 23 continues to the side opposite the waveguide 22 where the waveguide 14 having a rectangular cross section is arranged.

Figure 3:
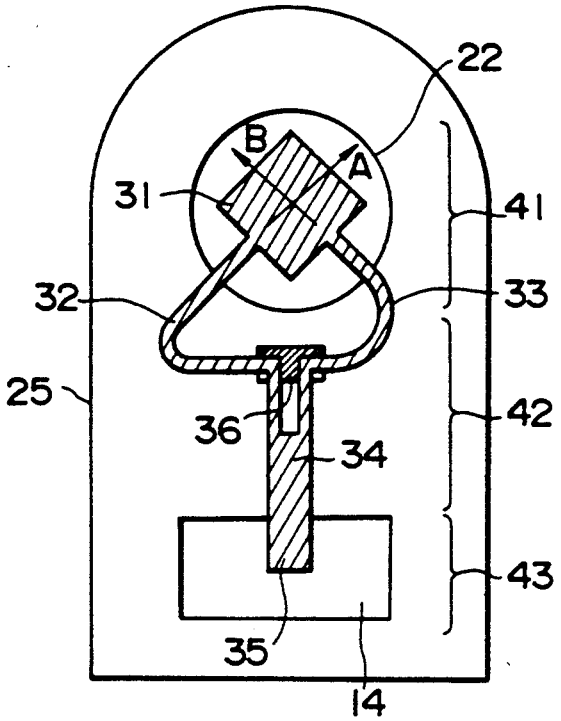
FIG. 3 is a diagram showing the conductor patterns formed on a film board of the embodiment shown in FIG. 2.

FIG. 3 shows the electrical conductor pattern formed on the film board 25, which pattern is typically formed of aluminum foil. The film board 25 is very thin and flexible and is formed of a flexible dielectric material such as polyester, polyethylene, or polyolefin. A probe 31, branches 32 and 33, a link 34 and another probe 35 are formed as a single, unitary pattern on the film board 25.

The conductor pattern may be formed on the film board 25 by applying a thin aluminum film to one surface of the polyester film board 25 and then etching away the unwanted aluminum to result in the desired pattern, such as shown in FIG. 3. Alternatively, the specified pattern can be directly deposited by sputtering or evaporating aluminum onto the dielectric film board 25. Because the film board 25 is usually formed of transparent material, such as polyester, the ends of the two waveguides 14 and 22 are shown in FIG. 3. Specifically, the round end of the circular waveguide 22 can be seen adjacent probe 31 and the rectangular end of the rectangular waveguide 14 can be seen adjacent probe 35.

The conductor branches 32 and 33 constitute a suspended line or microstrip 42 in conjunction with the link 34, which is also a portion of microstrip. The probe 31 serves as a converter 41 for converting from waveguide transmission to suspended line or microstrip transmission. on the other hand, the other probe 35 serves as a reverse converter 43 for converting the suspended line or microstrip transmission back into waveguide transmission.

As used herein, suspended line means a kind of microwave conductor, like microstrip or coaxial cable, that has an axial conductor, as opposed to a waveguide microwave conductor that does not have an axial conductor. Waveguides typically operate in the transverse electrical mode (TE) or the transverse magnetic mode (TM), with rectangular waveguides operating in the TE mode and circular waveguides operating in the TM mode. Because of the axial conductor, the microstrip or suspended line operates in a transverse electrical and magnetic mode (TEM). Thus, the mode conversion operation of the two probes 31 and 35 is seen and, moreover, the conversion operation of links 32, 33, and 34 from the TM mode of probe 31 through the TEM mode and back to the TE mode is appreciated.

The probe 31 has a generally rectangular shape and is fixed at a location in the end space 23 corresponding to the end of waveguide 22, that is, in the path of the waves exiting the waveguide 22. The branches 32 and 33 are connected respectively to two adjacent sides of the rectangular shaped probe 31, which are perpendicular to each other. In addition, the length of the transmission line of the branch 32 is made one-fourth of a wavelength (λ) longer than the length of the branch 33, where λ is the wavelength of the electromagnetic wave of interest being received. The other ends of the branches 32 and 33 are joined to each other by the link 34, which is further connected to the probe 35. The probe 35 is fixed in the space 23 at a location corresponding to the beginning end of rectangular waveguide 14, that is, in the path of the waves entering the waveguide 14. A printed resistor 36 is fixed at the juncture between the branches 32 and 33. As such, a Wilkinson-type compound circuit is formed. Resistor 36 can be a carbon resistor that is printed directly onto the polyester film board 25 and that connects the edges of conductor branches 32 and 33, and resistor 36 acts as a terminator for performing impedance matching.

In Japan, electromagnetic waves transmitted by a broadcast satellite have a circular polarity rotating in the clockwise direction. The electromagnetic wave is a resultant of two component fields that have directions perpendicular to each other. The phase of one of the component fields lags behind the other by 90 degrees. The conductor branch 32, which has a transmission path one-fourth of a wavelength (λ) longer than that of the other conductor branch 33, detects the component with the 90-degree leading phase, as shown by an arrow A in FIG. 3. Note that λ is the wavelength of received electromagnetic waves at the frequency of interest as described previously. On the other hand, the conductor branch 33, which has a transmission path one fourth of a wavelength (λ) shorter than that of the other conductor branch 32, detects the component with the 90-degree lagging phase denoted by an arrow B in FIG. 1. The component being conducted by the conductor branch 32 arrives at the link 34 with its phase lagging by 90 degrees behind that of the component conducted by the branch 33, because the transmission path of the former is one-fourth of a wavelength (λ) longer than that of the latter. Accordingly, due to the effects of conductor branches 32 and 33 at the link 34 the phase of both the two components will be the same. As a result, the probe 35 that is connected to the link 34 outputs linear-polarity waves that propagate through the waveguide 14 to the converter unit 15. At the converter unit 15, the linear-polarity electromagnetic waves are finally converted into an electrical signal.

The polarity rotating directions are used to suppress interference between two broadcast satellites which are relatively close to each other. In Japan, electromagnetic waves are transmitted with a polarity rotating in the clockwise direction as described earlier. If Korea, a neighboring country, also launches a broadcast satellite, for example, an attempt must be made to avoid radio interference in Japan by electromagnetic waves transmitted from the broadcast satellite of Korea and vice versa. Such interference can be avoided by making the polarity of the electromagnetic waves transmitted by the broadcast satellite of Korea, for example, rotate in the opposite or counter-clockwise direction.

According to the principle of operation described above, however, the antenna receives not only electromagnetic waves having a polarity rotating in the clockwise direction, but also will receive those with a polarity rotating in the counter-clockwise direction as well. In order to suppress the electromagnetic waves having a polarity rotating in the counter-clockwise direction, the printed resistor 36 is employed. By inserting the printed resistor 36, which performs an impedance match, only the electromagnetic waves with a polarity rotating in the clockwise direction are passed through. It should be noted that if it is desired to receive the electromagnetic waves with a polarity rotating in the counter-clockwise direction instead of those with a polarity rotating in the clockwise direction, the film board 25 is installed reversed in the left-to-right direction, that is, with branch 32 on the right and branch 33 on the left relative to the A and B orientation of FIG. 3.

Figure 4:
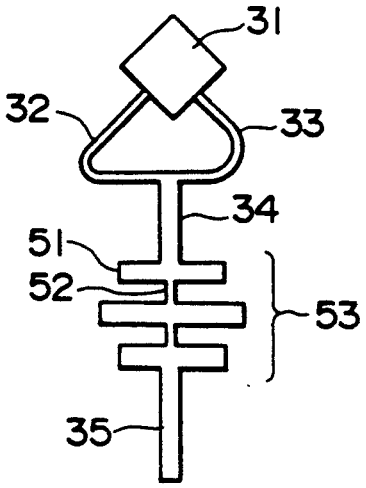
FIG. 4 is a diagram showing a conductor pattern according to another embodiment of the present invention.

FIG. 4 shows another embodiment for the microstrip conductor pattern formed on the film board 25 that includes a filter 53 comprising protrusions or stubs 51 protruding in the horizontal direction and small-diameter paths 52 formed as thin pipes in the vertical direction. The stubs 51 and the small-diameter paths 52 function as capacitive and inductive components, respectively. By combining the capacitive and inductive components, a filter having the desired characteristics can be implemented integrally with the polarity converter as a single conductor pattern on the film board.

Figure 5:
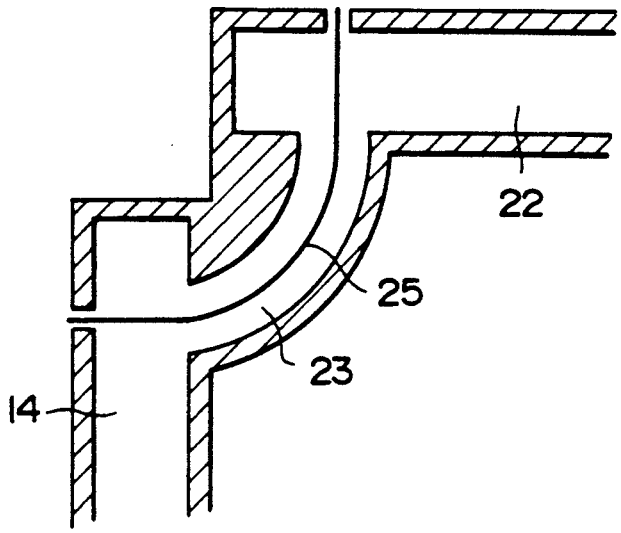
FIG. 5 is an elevation in cross section showing a connection of two waveguides according to an embodiment of the present invention.
Figure 6:
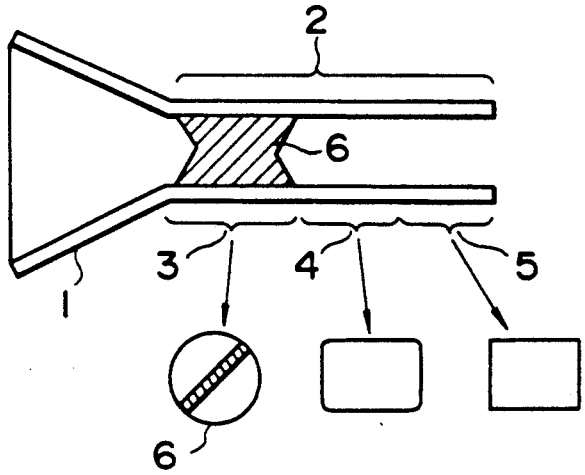
FIG. 6 is a diagram showing the configuration of a conventional polarity converter known in the prior art.

The film board 25 is extremely thin, having a typical thickness of 0.1 millimeters, so that it is highly flexible. Accordingly, the film board 25 can be easily bent to the form shown in FIG. 5. As a result, the position of the input waveguide 22 relative to that of the output waveguide 14 can be freely adapted to meet any particular requirement. In the embodiment of FIG. 5, the positions of the waveguides 14 and 22 are set so that their respective longitudinal axes form a right angle of substantially 90 degrees. Note that the dielectric substance 6 employed in the conventional polarity converter shown in FIG. 6 has a thickness on the order to 3 mm. Thus, unlike the film board 25, such a substance is difficult to bend.

As described above, the polarity converter provided by the present invention comprises a first probe, a suspended line or microstrip transmission line, and a second probe all of which are formed as a single, unitary device. By installing the first and second probes in first and second waveguides, respectively, not only can electromagnetic waves with a circular polarity be thereby converted into those having a linear polarity with ease, but the polarity converter itself can also be made small in size and can be manufactured at a low cost.

Having described preferred embodiments with reference to the accompanying drawings, it is to be understood that the invention is not limited to those precise embodiments and that various changes and modifications could be effected by one skilled in the art without departing from the spirit or scope of the novel concepts of the invention, as defined in the appended claims.

What is claimed is:

1. A polarity converter for converting circularly polarized electromagnetic waves into linearly polarized waves, comprising:

a first waveguide for guiding circularly polarized waves;

a second waveguide for guiding linearly polarized waves and mounted adjacent said first waveguide;

means for attaching an end of said first waveguide to an end of said second waveguide and for forming a cavity connecting said ends;

a film board arranged in said cavity and formed of thin, flexible, dielectric material and having an electrical conductor pattern formed on one side of said film board;

wherein said conductor pattern includes:

a first probe located at said end of said first waveguide;

a second probe located at said end of said second waveguide; and a microstrip transmission line connected to said first probe and connected to said second probe, whereby a circularly polarized wave received in said first waveguide is converted to a linearly polarized wave in said second waveguide.

2. A polarity converter according to claim 1, wherein said first probe is formed having a square shape with first and second portions thereof being located on a circumference at the end of said first waveguide at angular positions separated from each other by 90 degrees.

3. A polarity converter according to claim 2, wherein said microstrip transmission line includes a first transmission line conductor having one end connected to said first portion of said first probe and a second transmission line conductor having one end connected to said second portion of said first probe, wherein said second transmission line conductor has a length one-fourth of a wavelength of an electromagnetic wave being received longer than a length of said first transmission line conductor, and respective other ends of said first and second transmission line conductors are connected to each other and further comprising a resistance element connected between said first and second transmission line conductors proximate a point where said respective other ends are connected, said resistance element operating to pass only circularly polarized waves rotating in a selected direction.

4. A polarity converter according to claim 3, wherein said resistance element is a deposited film carbon resistor.

5. A polarity converter according to claim 1, wherein said electrical conductor pattern including said first and second probes and said microstrip transmission line is formed as a conductive metal foil pattern on said one said of said film board.

6. A polarity converter according to claim 5, wherein said means for attaching is formed as a substantially flat end plate and attaches said ends of said first and second waveguides so that a longitudinal axis of said first waveguide and a longitudinal axis of said second waveguide are arranged substantially parallel to each other.

7. A polarity converter according to claim 5, wherein said film board is formed of polyester film.

8. A polarity converter according to cali 7, wherein said means for attaching is folded to substantially 90-degrees and attaches said ends of said first and second waveguides so that a longitudinal axis of said first waveguide and a longitudinal axis of said second waveguide are arranges substantially perpendicular to each other, whereby said cavity is arcuately shaped and said film board is folded to reside therein.

9. A polarity converter according to claim 1, further including a filter connected to said microstrip transmission line between said first and second probes.

10. A polarity converter according to claim 9, wherein said filter is formed of stub elements and conductors having a narrow width relative to a width of said microstrip transmission line.

11. A polarity converter according to claim 10, wherein said stub elements comprise four stub arms of a first length and two stub arms of a second length longer than said first length.

12. An electromagnetic wave polarity converter for converting a circular polarity into a linear polarity, comprising:

a first waveguide for guiding a circularly polarized wave;

a second waveguide arranged proximate said first waveguide for guiding a linearly polarized wave;

means for attaching an end of said first waveguide and an end of said second waveguide and forming a cavity connecting said ends;

a thin film board formed of dielectric material and residing in said cavity so as to extend across an open end of said first waveguide and across an open end of said second waveguide;

a first probe formed of metal foil on one side of said film board and located at the open end of said first waveguide for receiving a circularly polarized wave therefrom;

a second probe formed of metal foil on said one side of said film board and located at the open end of said second waveguide for launching a linearly polarized wave thereinto;

a microstrip transmission line formed of a metal foil conductor pattern on said film board for connecting said first probe to said second probe and wherein said first waveguide has a circular cross section and said first probe has a square shape with first and second sides of the square shape located on the circumference of said first waveguide at angular positions separated from each other by approximately 90 degrees and said transmission line includes two separated metal foil conductor paths connected respectively to said first and second sides of the square shape; and a deposited film carbon resistor formed on said film board and electrically connecting said two conductor paths at a point proximate a point where said other ends of said two conductor paths are connected to each other, said resistor operating to pass only circularly polarized waves rotating in a selected direction.

13. A polarity converter according to claim 12, wherein a length of one of said two conductor paths is one-fourth of a wavelength of an electromagnetic wave being received longer than a length of the other of said two conductor paths and the other ends of said two conductor paths are connected to each other.

14. A polarity converter according to claim 12, further comprising a filter connected to said microstrip transmission line between said first and second probes and having stub arms and narrow path conductors formed on said film board.

15. A polarity converter according to claim 12, wherein said film board is bent through substantially 90-degrees and a longitudinal axis of said first waveguide and a longitudinal axis of said second wave guide are substantially perpendicular to each other.

16. A polarity converter for converting circularly polarized electromagnetic waves into linearly polarized waves, comprising:

a first waveguide for guiding circularly polarized waves;

a second waveguide for guiding linearly polarized waves and mounted adjacent said first waveguide;

means for attaching an end of said first waveguide and an end of said second waveguide and forming a cavity connecting said ends;

a first probe located at said end of said first waveguide;

a second probe located at said end of said second waveguide;

a microstrip transmission line for connecting said first probe to said second probe and being arranged to reside in said cavity and comprising a first transmission line conductor and a second transmission line conductor having a length one-fourth of a wavelength of a received electromagnetic wave longer than said first transmission line, a first end of said first transmission line conductor being connected to said first probe at a 90 degree angle relative to where a first end of said second transmission line conductor is connected to said first probe, a second end of each transmission line conductor being connected to each other; and a resistance element electrically connected between said two transmission line conductors at a point proximate a point where said second ends of said two transmission line conductors are connected to each other whereby only circularly polarized electromagnetic waves rotating in a first direction received by said first waveguide are passed by said resistance element and converted to a linearly polarized wave in said second waveguide.

17. A polarity converter according to claim 16, wherein said first and second probes and said microstrip transmission line are formed as a conductive metal foil pattern on a surface of a flexible non-conductive circuit board folded to substantially 90-degrees and a longitudinal axis of said first waveguide and a longitudinal axis of said second waveguide are arranged substantially perpendicular to each other.

* * * * *

UNITED STATES PATENT AND TRADEMARK OFFICE

CERTIFICATE OF CORRECTION

PATENT NO. : 5,276,410

DATED : January 4, 1994

INVENTOR(S) : Keiji Fukuzawa and Yoshikazu Yoshida

It is certified that error appears in the above-indentified patent and that said Letters Patent is hereby corrected as shown below:

In the claims:

Col. 6, line 25, change "said" first occurrence, to —side—

Signed and Sealed this

Twenty-third Day of July, 1996

Bruce Lehman

*Attest:*

BRUCE LEHMAN

*Attesting Officer*

*Commissioner of Patents and Trademarks*